United States Patent [19]

Ault

[11] Patent Number: 4,477,285

[45] Date of Patent: Oct. 16, 1984

[54] METHOD FOR TREATING AN OXIDIZABLE SURFACE

[76] Inventor: Frederick K. Ault, 3301 W. Petty Rd., Muncie, Ind. 47304

[21] Appl. No.: 298,207

[22] Filed: Aug. 31, 1981

[51] Int. Cl.[3] ..... C23G 1/02

[52] U.S. Cl. ..... 134/3; 51/306; 106/14.11; 106/14.13; 134/2; 134/7; 134/41; 252/80; 252/81; 252/82; 252/87; 252/105; 252/145; 252/174.15; 252/175; 252/178; 252/188.1; 252/188.28

[58] Field of Search ..... 51/306; 106/14.11, 14.13; 134/2, 3, 7, 41; 252/105, 188.1, 188.28, 80, 81, 82, 87, 145, 146, 174.25, 175, 178

[56] References Cited

U.S. PATENT DOCUMENTS

| | | | |
|---|---|---|---|
| 2,344,404 | 3/1944 | Giloy | 252/146 |
| 2,690,983 | 10/1954 | Meckler et al. | 252/174.25 X |
| 3,686,123 | 8/1972 | Hiroshi | 252/87 |
| 3,808,138 | 4/1974 | Yamaguchi et al. | 252/188 |
| 3,979,858 | 9/1976 | Semones et al. | 51/316 |
| 4,199,469 | 4/1980 | Walzer | 252/146 |

FOREIGN PATENT DOCUMENTS

| | | |
|---|---|---|
| 43-4163 | 2/1968 | Japan . |
| 1400198 | 7/1975 | United Kingdom . |

*Primary Examiner*—John E. Kittle
*Assistant Examiner*—Mukund J. Shah
*Attorney, Agent, or Firm*—Woodward, Weikart, Emhardt & Naughton

[57] ABSTRACT

A composition for use in treating surfaces susceptible of oxidation is disclosed herein which comprises the combination of a particulate abrasive material and a particulate, ascorbic-type reducing compound. A variety of percentages of the abrasive and reducing compounds may be employed, and the consistency of the abrasive material may be varied in accordance with the application for which the composition is intended. Also disclosed herein is a kit which includes a container of the described composition. A method for treating an oxidizable surface by use of a composition as described is also disclosed herein.

5 Claims, No Drawings

METHOD FOR TREATING AN OXIDIZABLE SURFACE

BACKGROUND OF THE INVENTION

1 Field of the Invention

The present invention relates to the field of treating surfaces, and particularly to treating surfaces which are susceptible to oxidation by abrading the surface and providing protection against oxidation.

2 Description of the Prior Art

There have been a great number and variety of products and methods in the prior art for treating oxidizable surfaces. Such treatment has two primary concerns. First, there is the treatment of the surface to remove a particular portion or layer which is either integral with or coated on the surface. This would include, for example, the removal of paint or other finishes applied to the surface as well as the removal of rust or other oxidized layers of the surface. Further, there is a simple desire to abrade the surface to provide a desired texture or smoothness. The second concern is the provision against undesired amounts of oxidation after this initial treatment of the surface. Typical approaches to this end have been the coating of such surfaces with an impenetrable material layer such as an oil or a paint. A more costly method is to handle the material in an oxidant-free atmosphere for the time required.

Materials and methods employed in the first consideration of surface treatments range from the simple and well known to the elaborate and highly specialized. The removal of the oxidized layer of a metal, i.e. rust, is typically accomplished in a commercial setting by treatment of the metal with a strong acid such as hydrochloric or sulfuric acid. Other conventional methods involve a simple abrading of the surface such as by use of a wire brush, emery cloth or other suitable device. Removal of other types of surface layers or coatings may similarly involve such treatments, as well as the use of specialized chemicals such as paint strippers and the like. In one aspect of the present invention, the surface treatment involves use of an abrasive particulate material which is applied to the surface and rubbed against the surface to abrade away the undesired layer or coating.

The second concern as indicated above is the protection of the initially treated surface to prevent undesired oxidation for a required period of time. In certain applications, the oxidation such as the rusting of certain metals is desired to be prevented for long periods of time, a matter of years. In other instances, however, it is only necessary although quite important to prevent the "flash" rust which will develop in a period of hours or days. In these circumstances, it would be possible to apply a protective coating for this limited period of time, although this can be cumbersome, expensive, and in fact may be detrimental to the subsequent treatment of the surface. It is an aspect of the present invention to provide protection to the abraded surface to prevent the flash rust from occurring for a period of perhaps a couple of days. In addition to the rusting of iron, steel and other types of metals, the present invention provides protection against all types of oxidizers.

SUMMARY OF THE INVENTION

In one aspect of the present invention there is provided a composition suitable for use in treating surfaces susceptible of oxidation, the composition including a particulate abrasive material and a particulate reducing compound comprising ascorbic acid or related compounds. In another aspect, the present invention provides a kit and a method which are directed to the treatment of an oxidizable surface, and which employ a composition including the particulate abrasive material and the particulate, ascorbic-type reducing compound.

It is an object of the present invention to provide a composition which is particularly adapted for the treatment of oxidizable surfaces, and more particularly for removing or modifying a surface layer or coating.

It is another object of the present invention to provide a composition which includes both an abrasive material for abrading an oxidizable surface, and also a reducing compound to provide protection against subsequent oxidation for limited periods of time.

A further object of the present invention is to provide a composition suitable for use in treating oxidizable surfaces, and more particularly which in various embodiments is adapted for the treatment of metals, woods, plastics, ceramics, and a variety of other types of materials having special surface textures and physical properties.

It is another object of the present invention to provide a kit which is adapted for use in the treatment of oxidizable surfaces.

A further object of the present invention is to provide a method for treating oxidizable surfaces, which method employs the abrasion of the surface layer or coating coupled with the protection of the surface from subsequent oxidation.

Further objects and advantages of the present invention will become apparent from the description of the preferred embodiments which follows.

DESCRIPTION OF THE PREFERRED EMBODIMENTS

For the purposes of promoting an understanding of the principles of the invention, reference will now be made to the preferred embodiments and specific language will be used to describe the same. It will nevertheless be understood that no limitation of the scope of the invention is thereby intended, such alterations and further modifications in the inventions, and such further applications of the principles of the inventions being contemplated as would normally occur to one skilled in the art to which the invention relates.

The present invention in various embodiments provides a composition, kit and method suitable for use in treating surfaces susceptible to oxidation. As used herein, the contemplated surfaces susceptible of oxidation, also referred to as oxidizable surfaces, are intended to include any surfaces which desirably are not contacted by an oxidant. As will be more fully described, the present invention involves a composition which includes a particulate reducing compound which is selected from a group of ascorbic-type compounds. The presence of these compounds on the surface will accept or intercept all types of oxidizers, and thus will act primarily as a protective agent for the surface.

It is also intended that the present invention is useful in treating an oxidizable surface either in removing an oxidized layer integral with the surface, or by treating or removing a coating, such as paint, upon the surface. Thus, in certain applications the primary action will be to abrade away a surface layer such as a rust layer on an iron metal, whereas in other cases the primary action will be to remove a surface coating such as paint upon an underlying surface which may be wood, metal, plastic, or other material. Therefore as used herein, the concept of applying the composition to the surface would include applying it directly to the uppermost layer of the surface or to a coating which has previously been applied to the surface.

In one aspect of the present invention there is provided a composition which is suitble for use in treating surfaces susceptible of oxidation. This composition comprises the combination of particulate abrasive material, particulate chelating agent, and a particulate reducing compound. The reducing compound is an ascorbic-type compound, or in otherwords is a compound selected from the group consisting of ascorbic acid, erythorbic acid, ascorbate salts, erythorbate salts, and esters or other derivatives of ascorbic and erythorbic acids, an mixtures thereof. The proportions of the two materials in the composition may vary considerably depending upon the effect that is desired for a particular application of the composition. A typical range of the composition would have the reducing compound present in an amount of from about five percent to about forty percent by weight of the composition. In certain instances, a more preferable composition has the reducing compound present in an amount of about ten percent by weight of the composition.

The chelating agent may be selected from a group of compounds including alkali metal gluconates, ethylenediaminetetraacetic acid (EDTA) or its derivatives, oxalic acid or its derivatives, and citric acid or its derivatives. Typical amounts of chelating agent in the abrasive mixture would be equimolar with the ascorbic acid compound used.

The abrasive material may include any material having suitable strength, integrity, hardness and the like to provide the required abrading treatment to the oxidizable surface. Again it will be appreciated that the requirements for the abrasive material will very depending upon the surface to be treated and the desired effect on the surface. Relatively soft abrasive materials may be suitable in certain applications, and indeed may be desirable where the surface is of a consistency that cannot withstand severe treatment. For example, one embodiment of the present invention would contemplate its use in cleaning the surface of ceramic, plastic, porcelain or other types of sinks or the like. In order to prevent damage to the finish of these and other types of materials, the abrasive material should not be too hard or too large in size. Conversely, other applications contemplate the use of this composition for treating metals for the removal of rust or other oxidized layers, and a much harder abrasive material is appropriate. The abrasive material can therefore be seen to be selectable from essentially any of the materials typically used as abrasive compounds. It has been found that certain abrasive materials are desirable from the standpoint of availability, cost, efficacy and the like, and these include aluminum oxide, zinc oxide and silicon carbide. In certain embodiments, it is preferable to include a mixture of aluminum oxide and zinc oxide as the abrasive material.

It has been noted that the composition includes both an abrasive material and a reducing compound which are present in particulate form. The composition typically would have a consistency of a coarse powder. The size of the particles can vary again depending on the application for the composition. The coarser or larger size particles will typically be more suitable for applications requiring greater abrasive treatment of the surface, such as in the removal of rust. Conversely, smaller or less coarse particle sizes will typically be appropriate for more delicate applications where damage to the surface texture might otherwise occur.

The composition of the present invention comprises an abrasive powder which includes the ascorbic-type reducing compound as previously described. The composition is useful on wood, plastic, metal and other materials, and also is well adapted for treating paint or other finishes. The ascorbic-type compound operates primarily as a protective agent to accept or intercept oxidizers which would otherwise contact the surface. The reducing compound will typically provide a reducing atmosphere which is protective of the surface. Also, the ascorbic-type compound is acidic in nature, and therefore has some action against rust and other materials which may desirably be removed from the surface. The acidity also will have operation in some applications such as in the treatment of calcium deposits on sinks and the like. Also, since the reducing compound denies the oxygen presence at the surface, the metal is not affected by an oxidation process.

The present invention also provides a kit which is suitable for use in treating surfaces susceptible of oxidation. Such kit would typically comprise a container in which the composition as previously described is received. The container includes an aperture to permit the composition to be dispensed from the container. Further, the container would include a closure means for providing closure of the aperture to retain the composition within the container, and also for providing an opening of the aperture to permit the composition to be dispensed from the container. A container of this type could be in the form of any of a variety of types such as presently available for containing and dispensing powder products. For example, the container could be a cylindrical shape having a shaker top, i.e. a top having several perforations, and also having a threaded top which is receive over the shaker top to close the container. Alternatively, the container can simply have a pour top which could either comprise simply an aperture in the top or an aperture combined with a spout such as is commonly available now for dispensing granular food products such as spices and cheese.

In another embodiment, the present invention includes a composition which is combined with a gel or other carrier to facilitate application of the composition to the surface intended for treatment. This gel is formed from a variety of gelling materials, with a preferred example being the use of a silica gel in conventional form. The gel or other carrier is desirably contained in a container such as a metal, plastic or glass jar, or is also contained in a metal or plastic tube such as is used for dispensing toothpaste. It should be noted that the ascorbic-type compound is affected by exposure to the atmosphere, except that any such effect is minimal for the granular or particulate form of the ascorbic-type compound. Thus, except in the instances of a particulate or granular form of the composition, it is important to provide a container or carrier for the composition which will prevent substantial attack of the ascorbic-type compound by the atmospheric oxygen or other oxidizing agents. In addition, an aerosol system would also be useful for dispensing the composition typically in a liquid form.

In a further embodiment, the present invention provides a method for treating a surface with is susceptible of oxidation. In accordance with this method, a composition of the type previously described is rubbed against the surface intended for treatment. In particular, it is desirable to rub the composition against the surface by means of a device such as a brush, a scrub pad, or a sheet material such as a paper towel or cloth. This method may also advantageously include the additional step of removing the abrasive material from the surface, particularly the removal of such material with deoxygenated water. The deoxygenated water most preferably includes a reducing compound selected from the group consisting of ascorbic acid, erythorbic acid, ascorbate salts, erythorbate salts, and esters or other derivatives of ascorbic and erythorbic acids, and mixtures thereof. Moreover, the rinse water preferably includes the reducing compound in an amount sufficient to substantially prevent oxidation of the surface for about twenty-four hours. In other words, the rinse water which is used to remove the abrasive material from the treated surface desirably has a sufficient amount of the ascorbic-type compound to provide a residue of the reducing compound sufficient to intercept oxidants which would otherwise attack the surface for a period of about twenty-four hours or desirably longer. Of course, the method of treating the surface with the composition will naturally leave a residue of the ascorbic-type compound even when rinsed with the deoxygenated water or other substance, and this residue will provide a degree of protection against oxygen attack for a limited period of time.

EXAMPLE 1

In a specific example of the present invention a composition was used to remove paint and rust from a metal surface. The composition included the combination of ascorbic acid and both zinc oxide and aluminum oxide as the abrasive particles. The composition included about ten percent of the ascorbic acid by weight, and was deposited on the matal surface and rubbed with a paper towel. A slight amount of moisture was added either to the metal surface, powder or rubbing material to enable the reducing activity to work during this process. It was found that a relatively light and short amount of rubbing was required to remove the visible rust and paint from the metal surface. In addition, similar procedure was used in which alternatively a brush or a scrub pad were used to rub the composition against the metal surface, with similar results.

EXAMPLE 2

The procedure of Example 1 was followed exactly except that various compositions were used which included ascorbic acid in the amounts of 5, 20 and 40 weight percent of the composition. Suitable results are achieved. In addition, the procedure of Example 1 was followed with compositions having the various percentage ranges of the ascorbic-type reducing compound, which in these compositions alternatively included erythoric acid, sodium ascorbate, sodium erythorbate, and the ascorbate or erythorbate esters, as well as mixtures thereof. Similar results are achieved.

EXAMPLE 3

The procedures of Examples 1 and 2 are followed except that the composition is applied to various woods, plastics and ceramics, with each of these having various surface textures. Application of the materials by use of the paper towel, brush or scrub pad were found to provide the desired result in removing the surface layer.

EXAMPLE 4

The procedures of Examples 1–3 are followed except that the abrasive material used is alternatively particulate aluminum oxide alone, particulate silicon carbide alone, or a mixture of two or more of the aluminum oxide, zinc oxide and silicon carbide. Also, different particle sizes are used. As previously noted, it is found that the different abrasive particles and sizes are suitable for various types of materials and surfaces. In particular, the softer and smaller abrasive particles are more desirable for the more delicate surfaces, whereas the harder and larger abrasive particles are more suitable for application with the stronger surfaces and those having surface layers that are more difficult to remove.

EXAMPLE 5

The above Examples are followed except that in addition to the described materials there is also included a chelating agent. In alternative procedures, the chelating agent includes ethylenediaminetetraacetic acid (EDTA), oxalic acid, citric acid and sodium gluconate, or mixtures thereof. The amount of chelating agent used is varied between 5 and 30 weight percent of the total composition. Excellent results are achieved, and a preferred embodiment is one utilizing an equimolar amount of the chelating agent and the ascorbic-type reducing compound.

EXAMPLE 6

The procedures of the above Examples are followed except that after treatment of the surface with the abrading composition the surface is rinsed with a deoxygenated water. In particular, a deoxygenated water includes one or more of the ascorbic-type reducing compounds. Further, the procedures involve the use of a water including the ascorbic-type compounds sufficient to leave a residue on the surface adequate to prevent substantial rust or other undesired oxidation for a period of about 24 hours. Excellent results are achieved.

EXAMPLE 7

The above procedures are followed by use of a kit or other packaged form of the composition. For example, the procedure of Example 1 is followed by use of a shaker container having a perforated top and a screw on cap. The cap is removed and the shaker is used to deposit the composition on the metal or other surface. Similarly, the procedures are followed utilizing a composition provided in an aerosol container, which is typically more suited to the use of the finer particle sizes. Also, the procedures are followed using a composition which has the ascorbic-type reducing compound and the abrasive particles suspended in a gel, such as silica gel, which is conveniently stored in a metal, plastic or glass jar or in a metal or plastic tube. The gel is dispensed from the appropriate container onto the surface and is rubbed against the surface by a suitable means. Excellent results are obtained.

While the invention has been described in detail in the foregoing description, the same is to be considered as illustrative and not restrictive in character, it being understood that only the preferred embodiments have been described and that all changes and modifications that come within the spirit of the invention are desired to be protected.

What is claimed is:

1. A method for treating a surface susceptible of oxidation which comprises the steps of: rubbing against the surface a composition which comprises the combination of particulate abrasive material and a particulate reducing compound selected from the group consisting of ascorbic acid, erythorbic acid, ascorbate salts, erythorbate salts and mixtures thereof; and removing said abrasive material from the surface, said step of removing comprising rinsing the surface with deoxygenated water.

2. The method of claim 1 in which said step of rinsing includes rinsing the surface with water containing a reducing compound selected from the group consisting of ascorbic acid, erythorbic acid, ascorbate salts, erythorbate salts and mixtures thereof.

3. The method of claim 2 in which said reducing compound is present in said rinsing water in an amount sufficient to substantially prevent oxidation of the surface for about twenty four hours.

4. The method of claim 1 in which said rubbing includes rubbing the composition against the surface with a device selected from the group consisting of a brush, a scrub pad and a sheet material.

5. A method for treating a surface susceptible of oxidation which comprises the steps of:

rubbing against the surface a composition which consists essentially of the combination of particulate abrasive material and a particulate reducing compound selected from the group consisting of ascorbic acid, erythoribic acid, ascorbate salts, erythorbate salts and mixtures thereof; and removing said abrasive material from the surface, said removing comprising rinsing the surface with water containing a reducing compound selected from the group consisting of erythorbic acid, ascorbate salts, erythorbate salts, and mixtures thereof.

* * * * *